US006371110B1

(12) United States Patent
Peterson et al.

(10) Patent No.: US 6,371,110 B1
(45) Date of Patent: Apr. 16, 2002

(54) AUTOMATIC RELEASE APPARATUS AND METHODS FOR RESPIRATOR DEVICES

(75) Inventors: Mark A. Peterson, Bensalem, PA (US); David L. Peterson, Ely, MN (US); Mark Allen Capozio, Sr., Feasterville; Michael W. Allen, Furlong, both of PA (US)

(73) Assignee: Enviromental Tectonics Corporation, Southampton, PA (US)

( * ) Notice: Subject to any disclaimer, the term of this patent is extended or adjusted under 35 U.S.C. 154(b) by 0 days.

(21) Appl. No.: 09/276,247

(22) Filed: Mar. 25, 1999

(51) Int. Cl.[7] ..... A62B 9/04

(52) U.S. Cl. ..... 128/202.27; 128/205.26; 128/206.12; 128/206.21; 128/207.11

(58) Field of Search ..... 128/201.22, 201.24, 128/202.12, 202.27, 203.29, 205.25, 205.26, 206.12, 206.21, 207.11

(56) References Cited

U.S. PATENT DOCUMENTS

| | | | | |
|---|---|---|---|---|
| 4,803,980 A | | 2/1989 | Nowakowski et al. | |
| 4,869,245 A | | 9/1989 | Nowakowski et al. | |
| 5,036,846 A | | 8/1991 | Aulgur et al. | |
| 5,074,297 A | | 12/1991 | Venegas | |
| 5,129,389 A | | 7/1992 | Tauscher et al. | |
| 5,441,046 A | * | 8/1995 | Starr et al. | 128/207.11 |
| 5,488,948 A | | 2/1996 | Dubruille et al. | |
| 5,499,624 A | | 3/1996 | Kruger et al. | |
| 5,503,147 A | | 4/1996 | Bertheau | |

FOREIGN PATENT DOCUMENTS

| | | |
|---|---|---|
| EP | 288 391 A | 10/1988 |

* cited by examiner

*Primary Examiner*—Glenn K. Dawson
(74) *Attorney, Agent, or Firm*—Akin, Gump, Strauss, Hauer & Feld, L.L.P.

(57) ABSTRACT

Apparatus and methods to automatically release a respirator device at least from a wearer's face. For a respirator mask, such apparatus includes a securement device, which fits around at least the rear side of a wearer's head, and one or more couplings which are configured to releasably secure the respirator mask with the securement device around the wearer's head. For a respirator hood, a neck dam is used as the securement device. Pressurized, breathable gas is supplied to the wearer through the respirator device and to the coupling(s) to secure the device to the wearer's head and, if and when pressure of the gas supplied to the device drops below a critical level, the pressure of the gas supplied to the actuator(s) also drops sufficiently for the actuator(s) to change states and allow the coupling(s) to separate, thereby releasing the device. Manual and/or remote release can also be provided. Pneumatic actuation and control are preferred but hydraulic, electric and/or electromagnetic control and actuator devices can also be used in hyperbaric chambers and elsewhere.

20 Claims, 11 Drawing Sheets

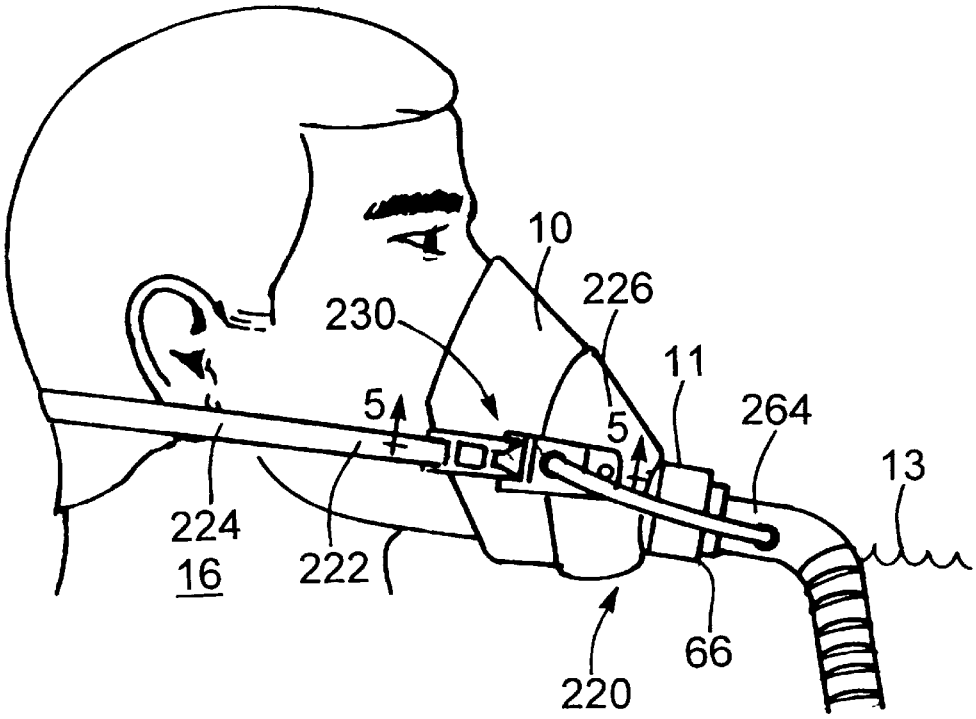
Fig. 4
Fig. 5
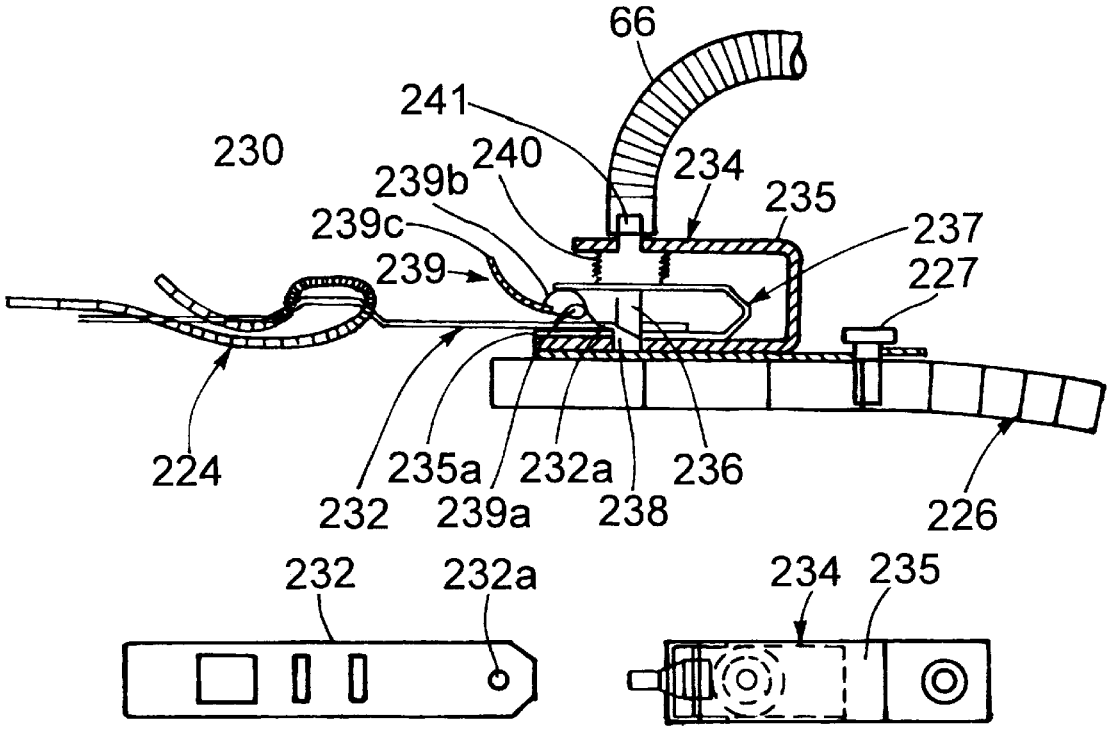
Fig. 6

AUTOMATIC RELEASE APPARATUS AND METHODS FOR RESPIRATOR DEVICES

BACKGROUND OF THE INVENTION

The invention relates to respirators and, in particular, to apparatus and methods for releasably securing respirator devices, namely masks, hoods and the like, to users.

Monoplace (one-person) and multiplace (two or more persons) hyperbaric chambers exist for various therapeutic treatments. Currently, a one hundred percent oxygen atmosphere is maintained within the chamber for the occupants of such chambers. There are dangers inherent in such an oxygen rich environment, in the form of increased flammability of materials, lowered ignition temperatures and increased rates of fire propagation. Several fires within such monoplace hyperbaric chambers have already been reported in Japan.

Respirator masks or hoods have not been used to supply oxygen to the occupants of such chambers so that a non-combustible or less combustible atmosphere may be used to pressurize the chambers. This is due to the inherent dangers of oxygen toxicity to the chamber occupant. Oxygen toxicity is the effect on the human nervous system of oxygen breathed at above atmospheric pressures. Symptoms of oxygen toxicity include seizures similar to epilepsy and may also include vomiting. If chamber occupants were equipped with masks or hoods to provide pressurized oxygen, vomitus from the patient would be contained by the mask or hood and could lead to drowning or asphyxiation. Monoplace hyperbaric chambers are designed to receive only a single occupant. Any attendant would be located outside of the chamber. The only way an attendant can reach an occupant within a pressurized chamber is to first depressurize the chamber. The occupant within a pressurized chamber can be put to further risk if the chamber is depressurized too rapidly. Thus, the use of a respirator mask or hood in such environments is fraught with dangers to the users and, for that reason, has not been adopted despite the significant risk of injury or death to users that exists from fire in such chambers.

OBJECTS OF THE INVENTION

It is an initial object to provide a safe apparatus and method for removal of a respiratory mask or hood from the face of a person, either automatically or manually remote from the mask or hood, or both.

It is yet another object of the invention to provide an apparatus and method for the safe use of a respirator mask or hood in a sealed monoplace hyperbaric chamber.

It is yet another object of the invention to provide an apparatus and method to attach a respirator mask or hood to a user only when the minimum breathable gas pressure being supplied to the respirator mask or hood is at least as great as the minimum operating pressure required by the mask or hood for safe use.

It is yet another object of the invention to provide an apparatus whereby a respiratory mask or hood attached to a user will automatically release from the user when the pressure of breathable gas supplied to the respiratory mask or hood falls below a minimum pressure required for proper operation of the mask or hood.

It is yet another object of the invention to provide an apparatus and method to release a respirator mask or hood from an unconscious or otherwise unresponsive user in the event of exhaustion of gas supply to the respirator mask or hood or failure of one or more components of the gas supply system apparatus or the provision of incorrect gas supply pressure due to operator error.

Each of the various forms of the invention fulfills at least one of these objects.

BRIEF SUMMARY OF THE INVENTION

In one aspect, the invention is an automatic release apparatus to use with a respirator device configured to cover at least part of a wearer's face so as to provide breathable gas to at least the wearer's mouth or nose, the automatic release apparatus comprising: a securement device configured to fit around at least part of a respirator device wearer's head; and a coupling configured to releasably secure a respirator device with the securement device to the wearer's head, the coupling including at least a first member and an actuator operatively yet releasably connected with the first member, the actuator having a gas inlet and being coupled with the first member so as to hold the first member in engagement to maintain the coupling at least while the actuator is pressurized by gas supplied to the actuator gas inlet and to release the first member to break the coupling and release the respirator device when the actuator is insufficiently pressurized.

In another aspect, the invention is a method of automatically releasing a respirator device at least from a wearer's face comprising the steps of: supplying pressurized breathable gas at least at a predetermined initial minimum pressure above ambient atmospheric pressure around the respirator device simultaneously to the respirator device and to an actuator of a coupling releasably securing the respirator device on the wearer's head, the coupling further including at least a first member, the actuator being operatively yet releasably connected with the first member of the coupling; and the actuator releasing the first member of the coupling to break the coupling and release the respirator device when the pressure of the breathable gas being simultaneously supplied to the respirator device and to the actuator drops below a minimum maintenance pressure above the ambient atmospheric pressure around the respirator device to operate the respirator device.

In yet another aspect, the invention is a method of automatically releasing a respirator device at least from a wearer's face, the method comprising the steps of: supplying pressurized breathable gas at least at a predetermined initial minimum pressure simultaneously to the respirator device and to an actuator of a coupling releasably securing the respirator device on the wearer's head, the coupling further including at least a first member, the actuator being operatively yet releasably connected with the first member of the coupling; and pressurizing the wearer together with the respirator device and coupling in a hyperbaric chamber with a breathable gas while simultaneously supplying to each of the actuator and the respirator device inner side, a breathable gas different in oxygen content from the breathable gas pressurizing the hyperbaric chamber.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings which are diagrammatic:

FIG. 4 is an elevation view of a second embodiment securement device and coupling of an automatic release apparatus of the present invention for a respirator mask;

FIG. 5 is a cross-sectional view taken along line 5—5 of FIG. 4;

FIG. 6 is an exploded plan view of the coupling of FIG. 4;

DETAILED DESCRIPTION OF THE INVENTION

Figure 1:
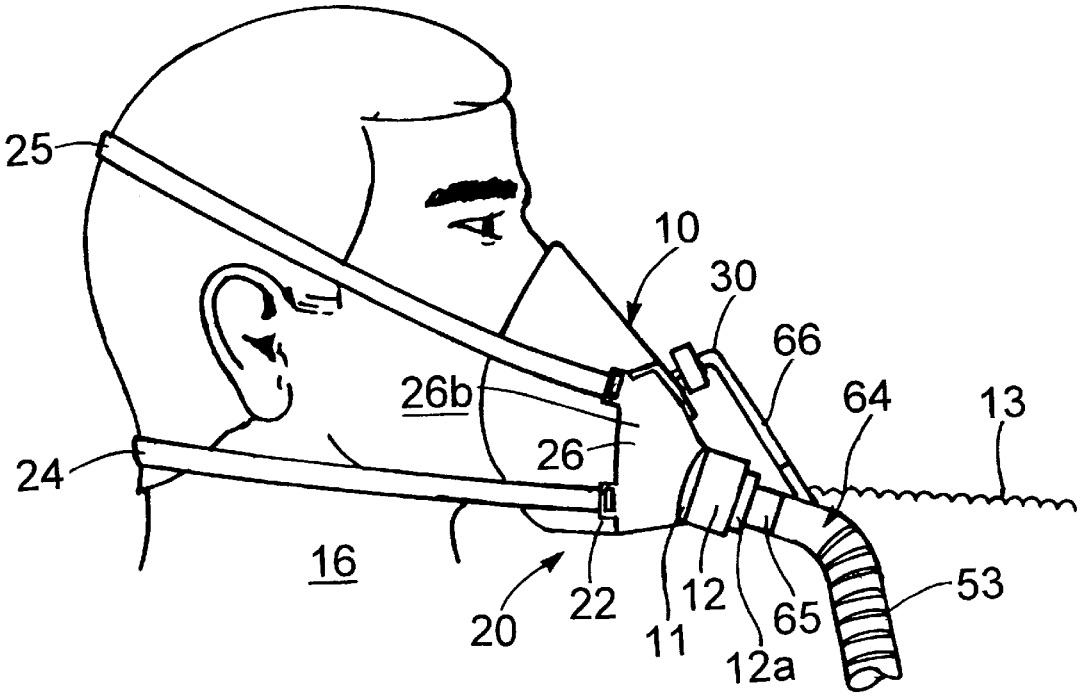
FIG. 1 is an elevation view of a respirator mask with first embodiment securement and coupling of an automatic release apparatus of the present invention for a respirator mask.

In the drawings, like numerals are used to indicate like elements throughout. FIG. 1 depicts a conventional respirator mask 10 having an inner side configured to fit against the face of a mask wearer 16 covering the wearer's mouth and nose. FIG. 1 further depicts part of an automatic release apparatus of the present invention for use with the respirator mask 10 and indicated generally in FIG. 3 at 20. The components of apparatus 20 depicted in FIG. 1 include a securement device indicated generally 22, which is configured to fit around at least a rear side of the head of the respiratory mask wearer 16, and a coupling indicated generally at 30 configured to releasably secure the respirator mask 10 with the securement device 22 around or on the head of the wearer 16.

Figure 2:
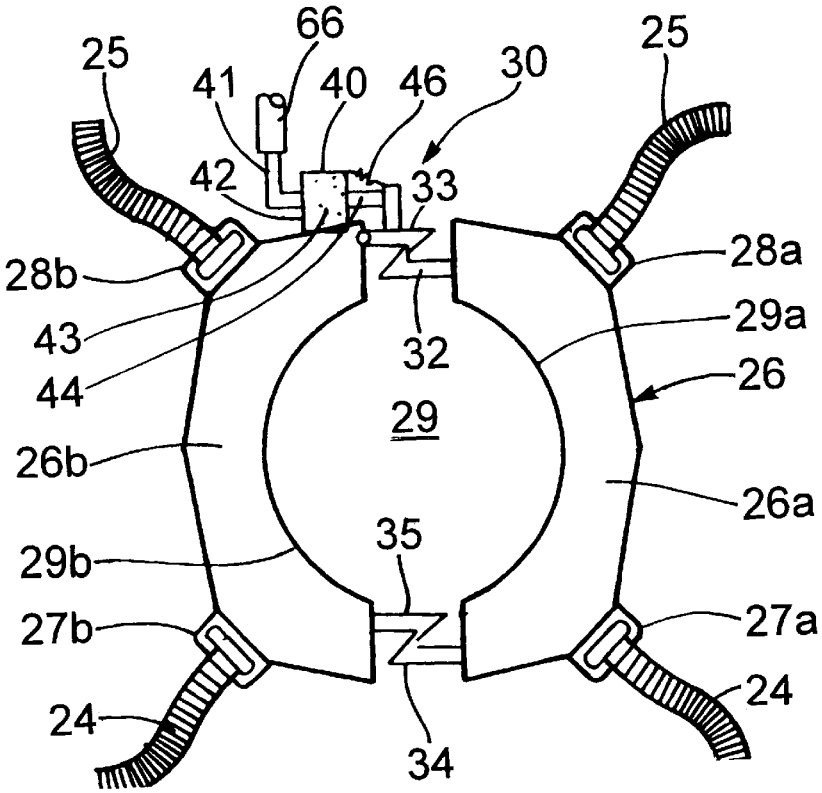
FIG. 2 is a plan view of a securement device of FIG. 1.

The main portion of the securement device 22 is shown in combination with the coupling in FIG. 2. The securement device 22 includes a strap 24, preferably two straps 24, 25, and a multipiece mask overlay 26, which is configured to at least partially overlie the respirator mask 10. At least one strap is suggestedly at least elastic and, more preferably, both straps 24, 25 are elastic and adjustable.

The coupling 30 releasably holds together pieces 26*a* and 26*b* of the overlay 26. Overlay piece 26*a* includes strap attachment points 27*a* and 28*a* for ends of straps 24, 25 while attachment points 27*b* and 28*b* are provided on overlay piece 26*b* for the remaining ends of straps 24 and 25, respectively. Each of the overlay pieces 26*a,* 26*b* includes a concave edge 29*a,* 29*b,* respectively, facing one another and forming a central opening 29 in the overlay 26 which receives the nose end 11 of the respirator mask 10.

The coupling 30 depicted includes at least a first member 32 in the form of a catch fixed on the first mask overlay piece 26*a* on one side of the central opening 29. In this embodiment, the coupling 30 further includes a second member in the form of a second catch 33 movable with respect to and releasably engagable with the first member/catch 32. The second member 33 is associated with the second mask overlay piece 26*b*. The "active" portion of the coupling 30 further includes an actuator 40 operatively yet releasably connected with the first member through the movable second member/catch 33 to either retain the second member/catch 33 in engagement with the first, fixed member/catch 32 or to release it from the fixed member/catch. Another pair of fixed catches 34 and 35 are preferably provided on each of the mask overlay pieces 26*a,* 26*b,* respectively, on an opposite side of the central opening 29 from the first pair 32, 33 and interferingly engage with one another holding together the facing edges of the mask overlay 26 on that side of the central opening 29. Preferably, the latching of these two fixed catches 34, 35 should be dependant on the alignment of at least overlay pieces 26*a,* 26*b* being maintained by the engagement of the active set of catches 32, 33 such that disengagement of catches 32, 33 causes the alignment of the overlay pieces 26*a,* 26*b* to change, disengaging catches 34, 35.

The actuator 40 is preferably provided by a pneumatic mini-cylinder 42 and piston 43 in the cylinder having an arm 44 connected with the movable second member/catch 33. The mini-cylinder 42 includes a gas inlet 41 which receives a pressurized gas from a source to be described through a pneumatic link 66. The arm 44 of the actuator 40 is coupled with the movable, second member/catch 33 so as to hold the first and second members together in engagement by holding the second member/catch 33 in engagement with the first member/catch 32 at least while the mini-cylinder 42 of actuator 40 is sufficiently pressurized by gas supplied to the inlet 41. Suggestedly, the end of arm 44 is connected with the movable second member/catch 33 by fixed engagement to withdraw the second member/catch 33 from engagement with the first member 32 in the absence of sufficiently pressurized gas at the gas inlet 41. Preferably, a separate bias member 46 in the form of a spring is coupled with at least one of the movable second member/catch 33 and arm 44 of the actuator 40 and with a fixed part of the mask 10, overlay 29 or apparatus 20 so as to positively disengage the second member 33 from the first member 32 in the absence of sufficiently pressurized gas at the inlet 41 to force piston 43 and arm 44 against second member/catch 33.

Figure 3:
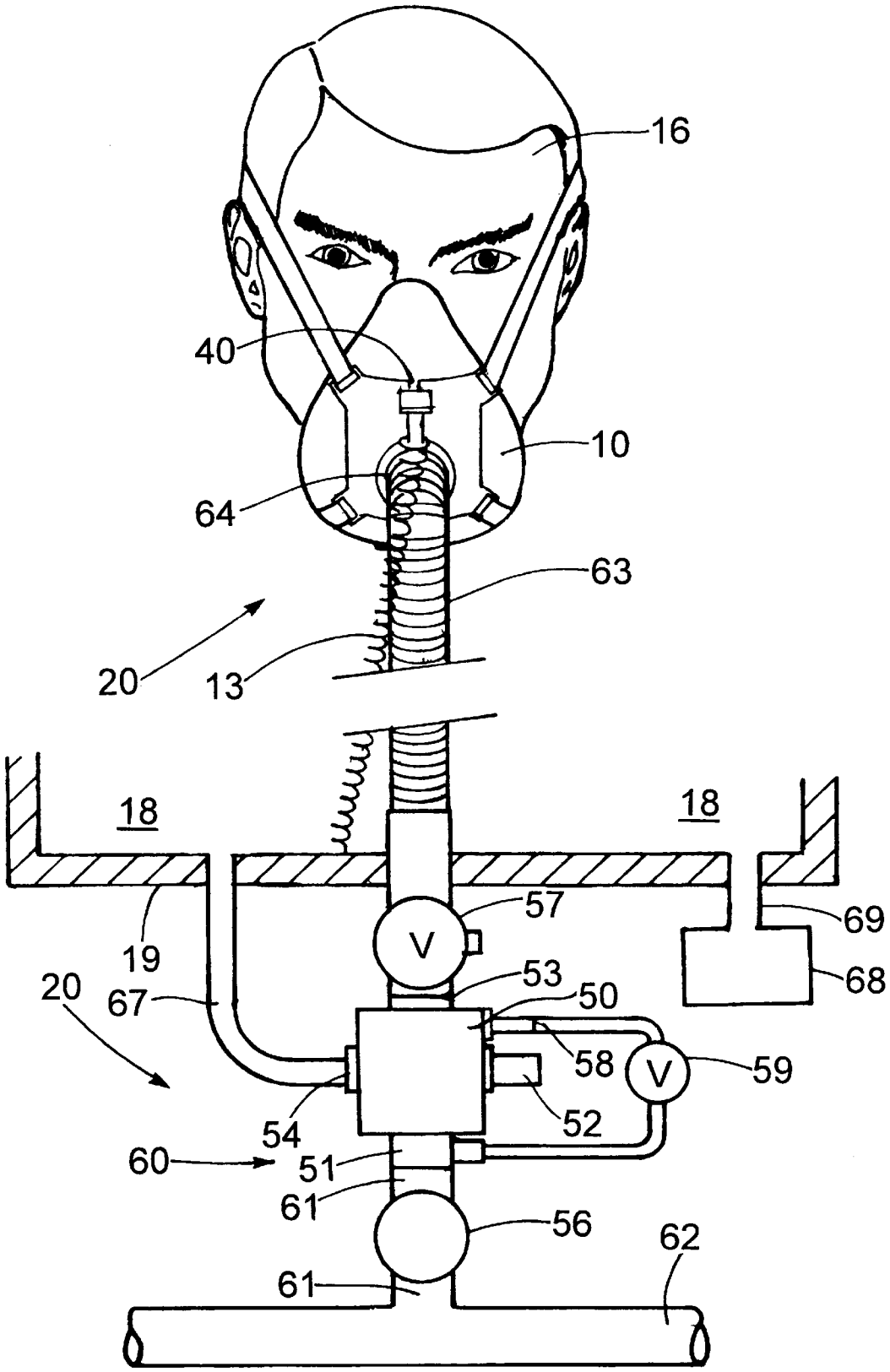
FIG. 3 is a schematic view of the securement device, coupling and respirator mask of FIGS. 1 and 2 in a monoplace hyperbaric chamber with the remainder of the automatic release apparatus.

Referring now to FIG. 3, other components of the automatic release apparatus 20 are depicted diagrammatically with the respirator mask 10 being worn by the wearer 16 in a hyperbaric chamber, preferably a monoplace chamber, indicated generally at 18, but also possibly a multiplace chamber with one or more occupant(s)/patient(s). A pressurized breathable gas supply network is indicated generally at 60.

A second, separate pressurized breathable gas supply indicated schematically by box 68 separately supplies another breathable gas to the interior of the hyperbaric chamber 18 through independent pneumatic link 69. The two breathable gases are normally measurably different from one another in at least one aspect. For example, the oxygen content of the pressurized breathable gas being provided by the supply 62 to the interior of the respirator mask 10 and the mask wearer 16 may be measurably higher in content or quality or both than the oxygen content of the other pressurized breathable gas from the second supply 68 being used to pressurize the interior of the hyperbaric chamber 18 or may contain added components such as a medication or an anaesthetic.

Breathable gas supplied to conventional regulator masks 10 must be pressurized above ambient atmospheric pressure on the mask for the mask to properly operate. Manufacturers normally specify the minimum safe pressure difference. A typical operating pressure differential range for conventional respirator masks like mask 10 is 65 to 200 psig above the ambient pressure in which the mask is operating. Many monoplace hyperbaric chambers operate at a maximum pressure of 30 psig. The automatic operating gas pressure actuated valve 50 should be set to switch states at the minimum pressure difference recommended by the respirator mask (or hood) manufacturer for safe operation of the mask (or hood), for example, a 65 psi differential.

The additional components of the automatic release apparatus 20 preferably include an automatically operating gas pressure actuated valve 50. The valve 50 includes a first pressurized gas inlet connection 51, a vent to atmosphere 52, a second gas connection 53 pneumatically connected with at least the actuator 40 of the automatic release device 20 and a third gas connection 54 pneumatically connected with the interior of the hyperbaric chamber 18 to sense ambient atmospheric pressure within the hyperbaric chamber 18. A fourth gas connection 58 is provided in the case of a preferred valve 50, a pilot-operated, Clippard Model R-321 automatic valve, for supply of a reference pressure used by the automatic valve (Clippard 321) for setting the pressure differential between ports 51 and 54 which will cause the automatic valve to change states. A fixed or preferably adjustable pressure regulating valve 59 may be provided to set the pressure differential. The Clippard R-321 valve can be configured to change states from gas passage from port 51 to port 53 to a second state of closure and venting of the port 53 when the pressure of the gas differential sensed at connection 58 is less, by a set differential, than the pressure supplied to connection 54. For example, the breathable gas being supplied from supply 61 to valve 50 may be passed through a reducing valve 59 to the reference port 58. The pressure of the breathable gas, which is significantly greater than the pressure supplied to the hyperbaric chamber for mask 10 to operate is reduced to a level closer to that supplied to the chamber so that, if the pressure of the breathable gas from supply 61 drops to a predetermined differential with respect to the pressure of gas supplied to chamber 18, the pressure of the gas supplied to port 58 will drop below that sensed at port 54, causing valve 50 to trip. The preferred automatic valve 50 or a similar arrangement provides at least 1) single-point control of the differential pressure at which the actuator(s)40 changes states and 2) at least nearly simultaneous release of all actuators 40 if more than one is provided.

Pressurized breathable gas is simultaneously supplied through the mask 10 to the respirator mask wearer 16 and to the actuator 40 of the mask coupling 30. More specifically, the first pressurized gas inlet connection 51 of the automatically operating gas pressure actuated valve 50 is coupled by a pneumatic link 61 to a pressurized breathable gas supply indicated schematically by tube 62. Actuator valve 50 controls the passage of pressurized breathable gas from the supply 62 to both the mask 10 and the actuator 40 through the remainder of the supply network 60. The remainder of the pressurized breathable gas supply network 60 further includes a pneumatic link 63 from the second pneumatic connection 53 of the valve 50 to a branch or manifold 64. Referring back to FIG. 1, separate pneumatic links 65 and 66 simultaneously couple the manifold 64 to the mask 10 and actuator 40, respectively (see FIG. 1). Preferably, respirator mask 10 is conventional and includes a gas pressure regulator 12 at the nose end 11 which is pneumatically connected with the interior side of the respirator mask and supplies breathable gas to the mask wearer 16 at an appropriate pressure. A pressurized gas inlet 12*a* of the regulator is coupled to the manifold 64 Pneumatic link 66 is coupled with the gas inlet 41 of the actuator (see FIG. 2). The manifold 64 and link 66 of the network 60 thus simultaneously pneumatically connect together the actuator 40 and the inlet of the pressure regulator 12 of the respirator mask 10 at a common gas pressure namely that of the breathable gas being supplied through the valve 50.

Independent pneumatic link 67 preferably extends through the chamber wall 19 from the interior of the hyperbaric chamber 18 to the third pneumatic connection 54 of the valve 50, thereby pneumatically connecting the valve 50 with ambient atmosphere within the chamber 18 including that immediately surrounding the respirator mask 10 being worn in the chamber 18.

Preferably, a first manually operated valve 56 is provided in the pneumatic link 61 between the pressurized breathable gas supply 62 and the first pressurized gas inlet connection 51 of the valve 50 and a second manually operated valve 57 is provided in the pneumatic link 63 between the second outlet pneumatic connection 53 of the valve 50 and the manifold 64. The second manually operated valve 57 is thus operatively located between the valve 50 and the actuator 40 and regulator 12. Preferably both valves 56, 57 are located outside the hyperbaric chamber 18 for direct control by an operator. Manually actuated valve 56 is preferably a shut-off valve having two positions which alternatively permit or prevent pressurized gas from the supply 62 to flow through the first pneumatic link 61 to the valve 50. The second manually operated valve 57 is a vent valve which also has only two states, one permitting pressurized gas from supply 62 to flow from valve 50 through the remainder of the supply network 60 and a second state which seals the link from port 53 of valve 50 and simultaneously vents to atmosphere that portion of the supply network 60 including the actuator 40 pneumatically coupled with valve 57.

The preferred Clippard R-321 valve 50 includes a main valve member which controls the passage of gas from pneumatic link 61 through the remainder of the pressurized gas supply network 60 and a pilot valve which controls the state of the main valve member. The pilot of valve 50 is pneumatically coupled with the pressurized breathable gas from supply 62 on pneumatic link 61 and with the interior of the hyperbaric chamber 18 through independent pneumatic link 67. The pilot of the Clippard R-321 valve can be adjusted as previously described by setting the supply (reference) pressure of valve 59 to set a minimum pressure difference between the pressurized breathable gas being received on pneumatic link 61 from supply 62 and the ambient atmosphere pressure within the hyperbaric chamber 18 to switch the states of the valve. Valve 50 has two states. A first state is maintained when the pressure of the breathable gas from supply 62 exceeds the ambient atmosphere pressure within the hyperbaric chamber 18 by the predetermined minimum amount. In the first state, the breathable gas from supply 62 is passed in pneumatic link 61 through the valve 50 and the remainder of the gas supply network 60 to the actuator 40 and mask regulator 12. The second state of valve 50 is maintained when the pressurized breathable gas from source 62 drops in pressure sufficiently close to the ambient pressure on the mask to be below the predetermined minimum amount (e.g., the recommended pressure difference between gas supplied to the mask and ambient pressure on the mask). In the second state, the pneumatic link 61 is closed at the valve 50 and the remainder of the supply network 60 downstream from valve 50 is vented to atmosphere outside the hyperbaric chamber 18 through the vent 52, thereby effectively depressurizing the mask 10 and the actuator 40.

Piston 43 of actuator 40 could be made double-acting so that a reversal in pressure on the piston 43 causes the piston 43 to move in a way which moves second member/catch 33 from engagement with the first member/catch 32. More conventionally, bias member 46 is provided to positively displace the second member/catch 33 or the arm 44 of piston 43, assuming that arm is interlocked with the second member 33 sufficiently to disengage the second member 33 from the first member 32 once pressure is lost in the actuator 40. Upon release of the catches 32, 33 and 34, 35, elastic strap(s) 24 and/or 25 pull the separate pieces 26*a,* 26*b* of the overlay further apart, thereby freeing the mask 10 from the wearer's face. A separate bias member 13 may be connected with the mask directly or indirectly, (see FIG. 1) and with a base member such as the wall 19 of chamber 18 or the like, to pull (or push) the mask 10 from the wearer's face when the pieces 26*a,* 26*b* of the overlay 26 separate.

The automatic release apparatus 20 is used with the respirator mask 10 as follows. The manual vent valve 57 is placed in its initial "on" state to permit the entire gas supply network 60 to be pressurized. The manual shut-off 56 is placed in its open state and a pressurized breathable gas from the supply 62 is passed through the network 60 and valves 50 and 57 to both the actuator 40 and the mask regulator 12, thus providing a breathable gas supply to the mask wearer 16. The mask 10 can be placed on the wearer 16 and held with the mask securement device 22. The mask 10 is held against the wearer's face covering the wearer's nose and mouth by the assembled overlay 26 and strap(s) 24(,25) extending around the rear of the wearer's head. The second member/catch 33 is held in engagement with the first member/catch 32 by the pressurized actuator 40. The operator/attendant leaves the wearer 16 in the chamber 18 which is then sealed and pressurized with breathable gas from a second supply 68. Suggestedly, the breathable gas from the first supply 62 is pure oxygen or at least a breathable gas with an other than normal air make-up (for example, more than 21% oxygen content), to provide an enriched oxygen atmosphere directly to the wearer 16. The gas from the second supply 68 can be ordinary pressurized air or any breathable mix of gas. Should the pressure from the first breathable gas supply 62 drop below that which is necessary for safe operation of the mask 10 within the pressurized chamber 12, the valve 50 will automatically switch states and vent the actuator 40 and remainder of the gas supply network 60 to atmosphere. This causes the actuator 40 to change states to permit the overlay pieces 26*a,* 26*b* to separate, releasing the mask 10. Should the operator need or desire to release the mask from outside the chamber, the operator could turn the first valve 56 to "off" or manually reverse the state of the second, vent valve 57 to vent the gas supply network 60 downstream from the valve 57. The loss in pressure caused by closing valve 56 and the use of the residual pressurized gas contained in valve 50 would also cause the actuator 40 to change states and release the respirator mask 10. Alternatively, if valve 57 is a three-way ball valve, rotating the valve 90° will block the input from port 53 to the mask 10 and actuator 40 while at the same time venting both portions to ambient pressure external to the hyperbaric chamber.

FIGS. 4–6 depict components of a second embodiment automatic release apparatus of the present invention for respirator mask indicated generally in those figures at 220. The apparatus 220 includes a securement device indicated generally at 222 and a coupling indicated generally at 230 configured to releasably secure the respirator mask 10 with the securement device 222 around the head of the wearer 16. The securement device 222 is now provided by one or more strap(s) 224, which is preferably both elastic and adjustable, and a one-piece mask overlay 226, which is configured to at least partially overlie the nose end 11 of the respirator mask 10. One coupling 230 releasably holds one end of the strap 224 with the overlay 226.

Details of the coupling 230 are shown in FIGS. 5 and 6. The coupling 230 includes a first member in the form of clip 232, which may be fixedly or, preferably, adjustably mounted to one end of the strap 224, and a buckle 234 receiving clip 232. Buckle 234 includes a frame having at least one open side 235 having a slot 235*a* on one side, which receives the free end of the clip 232, and an engagement member or "tongue" in the form of a pin 236. Clip 232 has a transverse central opening 232*a* which aligns with and receives the pin 236 when the clip 232 is fully inserted into the slot 235*a* of the buckle 234. Preferably a bias member in the form of a U-shaped, bent spring member 237 in the frame 235 supports the pin 236 and biases the pin away from engagement with the clip 232 when unpressurized. Pin 236 may be mounted on bias member 237 or mounted to or integral with the outer face of the actuator 240. The coupling 230 further includes a pneumatic actuator 240 having a gas inlet 241. The actuator 240 is an expandable chamber having an accordion wall. The outer face of the actuator contacts the spring 237. When pressurized, actuator 240 compresses the spring 237 and forces the pin 236 towards the clip 232 and through its central opening 232*a* to directly engage the clip. Buckle 234 further preferably includes a pin receptacle hole 238, into which pin 236 extends, providing lateral support to pin 236 when extended. Buckle 234 preferably has an over center cam indicated generally at 239 including a pivot 239*a* on the frame 235, a cam member 239*b* rotatably mounted on the pivot 239*a* and a handle 239*c* extending from one side of the cam member 239*b*. As can further been seen in FIG. 5, the buckle 234 is fixedly secured to the overlay 226 or directly to the respirator mask 10, by suitable means such as a rivet 227 or other fastener, preferably one which lets the buckle 234 rotate on the overlay 226 or mask 10. Preferably the remainder of the apparatus 220 includes valves 50, 56 and 57 and pressurized breathable gas supply network 60 including the pneumatic link 66 connected to the gas inlet 241 of the actuator 240.

Operation of the apparatus 220 is generally the same as apparatus 20. However, because separation now occurs between the strap and the overlay, the strap may be caught behind the head of the wearer 16 when the coupling 230 releases. Preferably a coupling 230 is provided at either end of the strap 224 where either end attaches to the overlay 226 so that both strap ends release and free the mask and overlay from the wearer's face. To that end, the gas supply network 60 may include a modified manifold 264 having one inlet and three outlets. If two straps were provided, additional coupling(s) 230 and a different manifold or multiple manifolds would be provided to service each individual coupling 230. Again, a bias member 13 (FIG. 4) is preferably provided on one of the mask 10 or the overlay 226 or the manifold 264 to positively move the mask and overlay from the wearer's face when the coupling 230 releases.

Figure 7:
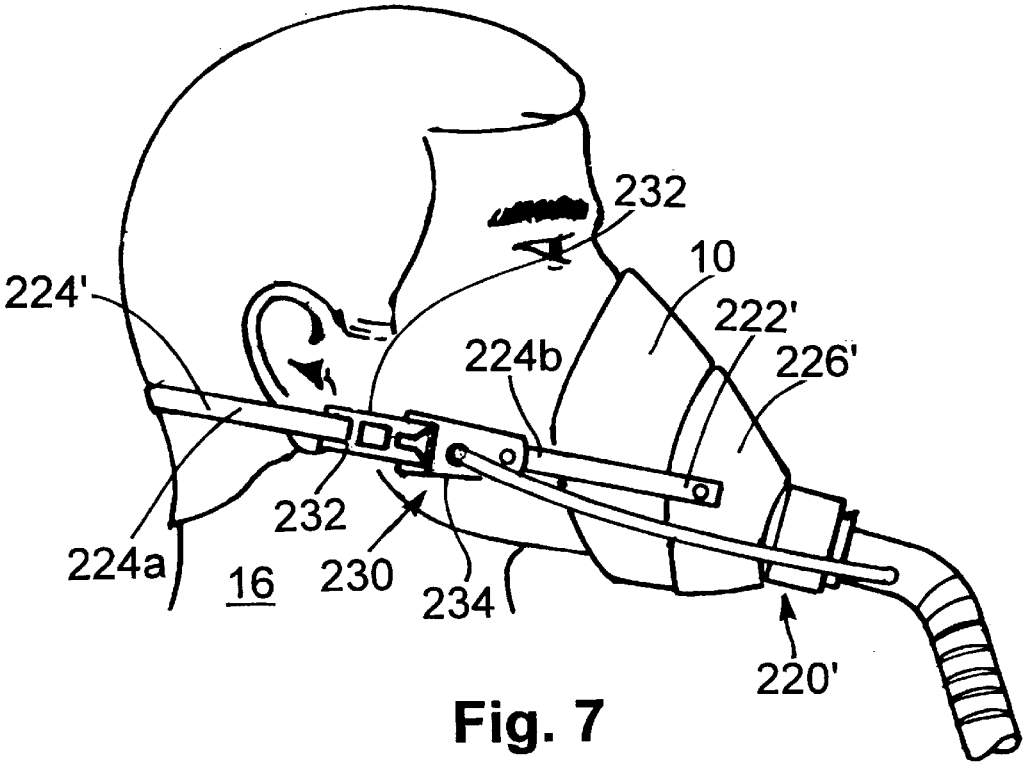
FIG. 7 is an elevation view of the coupling of FIGS. 4–6 mounted differently to the securement device.

FIG. 7 depicts a modification of the automatic release apparatus 220 of FIGS. 4–6 indicated generally at 220' in which the mask securement device 222' is provided by a strap assembly, shown generally at 224', the extreme ends of which are attached to opposite sides of a one-piece overlay 226'. In this embodiment, the coupling 230 is mounted between adjoining ends of two pieces 224*a*, 224*b* of the strap 224'. At least one of the strap pieces 224*a*, 224*b* is preferably elastic and at least one of the strap pieces, not necessarily the elastic piece, is also preferably adjustably mounted to the clip 232, the buckle 234 or the overlay 226'.

Figure 8:
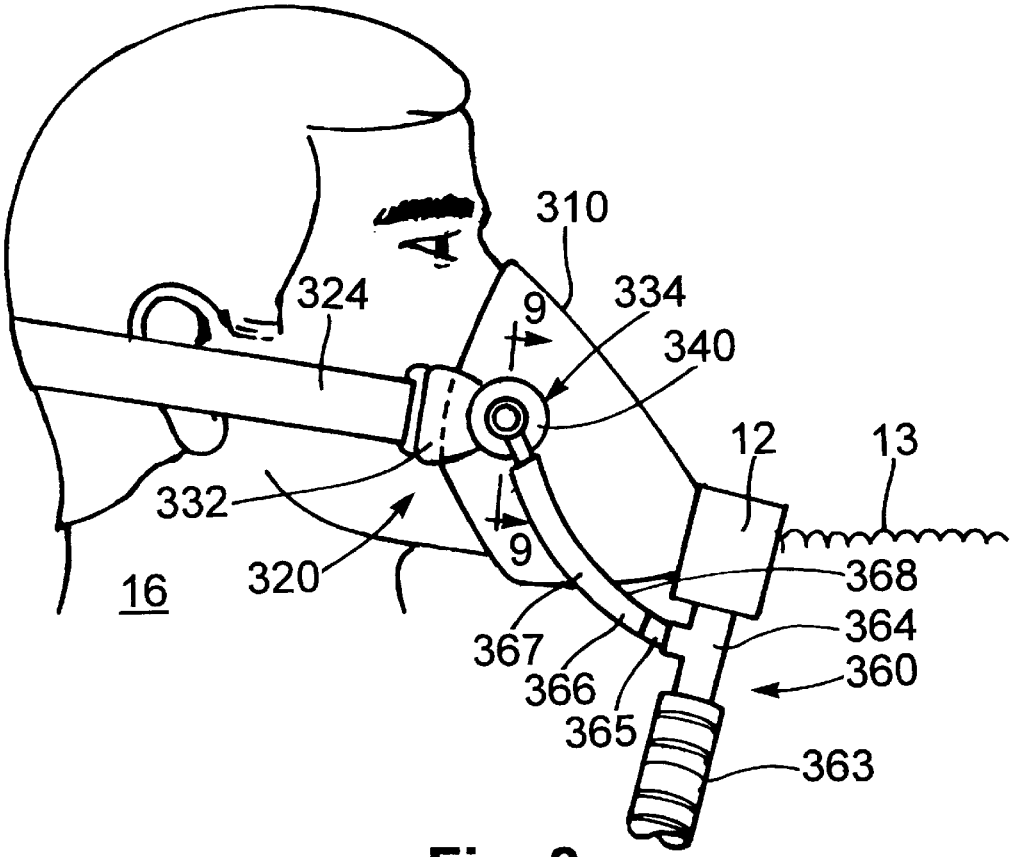
FIG. 8 is an elevation view of a third embodiment securement and coupling of an automatic release apparatus for respirator mask differing from the components of the first two embodiments.
Figure 9:
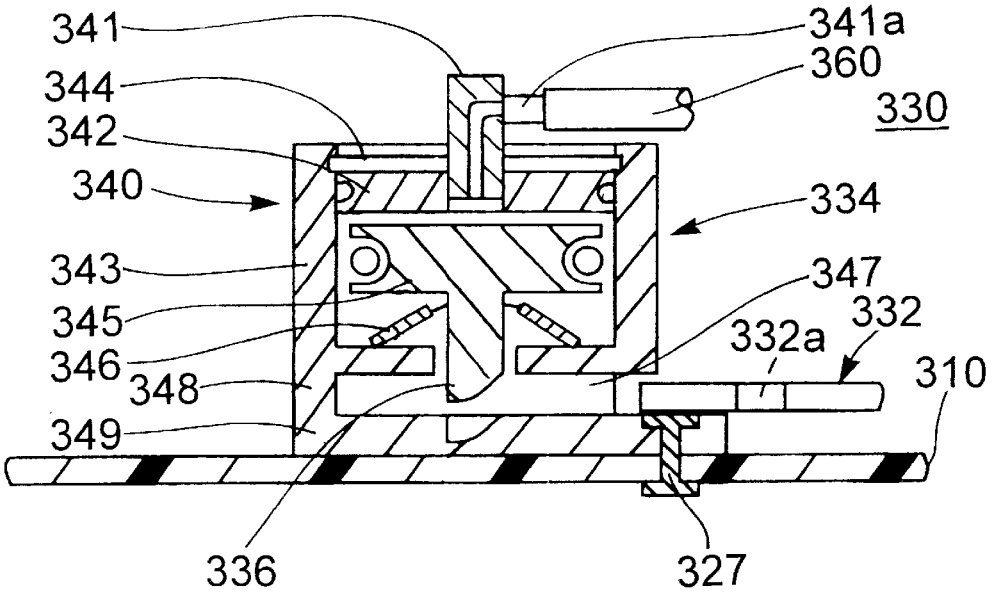
FIG. 9 is a cross-sectional view taken along lines 9—9 of FIG. 8.

FIGS. 8 and 9 depict components of another automatic release apparatus of the present invention for respirator mask, which is indicated generally at 320. These components are different, at least in some respects, from the components of the apparatus 20 and 220 previously described. An otherwise conventional respirator mask 310 is modified to mount the actuator 340 and movable portion of a coupling 330 indicated specifically in FIG. 9. The depicted components of apparatus 320 also include a securement in the form of at least one strap 324. The coupling 330 includes a clip 332 mounted on a free end of each provided strap and a buckle 334 for each clip 332. Again, a bias member 13 can be attached to the mask 310 or a portion of the gas supply network 360 or a manifold and to another stationary member to positively pull the mask 310 from the wearer's face after release. Although only one coupling 330 is depicted in FIG. 8 connecting one end of strap 324 to mask 310, the remaining end of strap 324 is similarly releasably coupled to the hidden side of mask 310 by a similar coupling 330 pneumatically connected to manifold 364.

Referring to FIG. 9, each clip 332 has a transverse central opening 332*a* (in phantom) which aligns with a movable pin 336 when the clip is received in a slot 347 in the buckle 334. The buckle 334 is affixed directly to the mask 310 by suitable means such as a rivet 327 or other fastener. Still referring to FIG. 9, the buckle 334 includes an actuator 340 preferably having a conventional 90 degree fitting 341 that has one end which forms a gas inlet 341*a*, and another end which is received in an end plate 342. End plate 342 is held in place in one end of a mini cylinder 343 by a circlip 344. A piston 345 is slidably located within the cylinder 343 and is fixed on one end of the movable pin 336. A bias member in the form of a Belleville washer 346 or coil spring (not depicted), for example, biases the piston 345 and pin 336 away from the clip 332 which is received in the slot 347 formed in one side of the buckle 334 by a support wall 348 connecting the mini cylinder 343 to a base wall 349. Again, a pressurized breathable gas supply network indicated generally at 360 is provided to couple the mask 310 and actuator 340 of the coupling 330 to a pressurized breathable gas supply (not depicted). Network 360 includes a pressurized breathable gas pneumatic link 363 extending from the valve portion of the apparatus (e.g., valves 50, 56, 57, 59 in FIG. 3) to a first manifold 364 in the form of tee, one end of which is coupled to the regulator 12 of the mask 310. Another pneumatic link 365 extends from the tee 364 to another tee 366. Pneumatic links 367 and 368 (phantomed behind mask 310) extend from the tee 366 to the gas inlets 341 of individual actuators 340 on opposite sides of mask 310. While a single strap 324 is shown attached by a pair of couplings to mask 310, a second strap and another pair of mask couplings (none depicted) can be provided attaching the ends of the second strap to the mask 310. Additional tees can be provided upstream or downstream from the second tee 366 (or a five port manifold can be provided) to pneumatically couple the additional couplings to the gas supply network.

Figure 10:
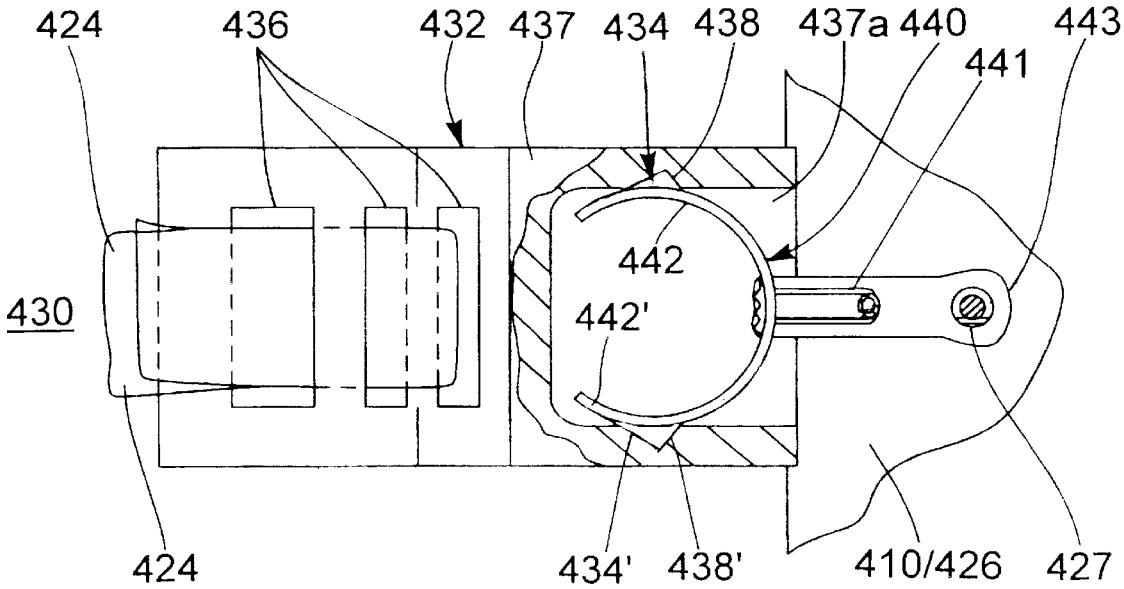
FIG. 10 is a partially broken away plan view of the components of another coupling embodiment of the present invention for an automatic release apparatus for respirator mask, which differs from the components of the previous embodiments.

FIG. 10 is a partially broken away view of another coupling embodiment indicated generally at 430 of an automatic release apparatus of the present invention for respirator mask. The coupling 430 includes a first member in the form of a clip 432 which receives an actuator indicated generally at 440 preferably with a second member in the form of at least one catch 434 supported on or integral to the actuator. Actuator 440 is a Bourdon tube 442 with a pneumatically coupled gas inlet 441 projecting out of the plane of the figure. Preferably, a second, mirror image catch 434' is provided on a mirror image extension 442' of Bourdon tube 442. Clip 432 may be provided with one or more attachment openings 436 to receive an end of strap 424 and with a housing 437 having an open end 437*a* receiving the actuator 440. Notches 438, 438' preferably are provided on opposite internal sidewalls of the housing 437, when catches 434, 434' are provided, to receive and releasably engage the catch(es) 434, 434' being carried on at least one Bourdon tube 442 and/or 442', respectively. Actuator 440 may be fixed to a mask or overlay 410/426 by means of a strap 443 and a fastener 427 such as a rivet or other suitable means.

Figure 11:
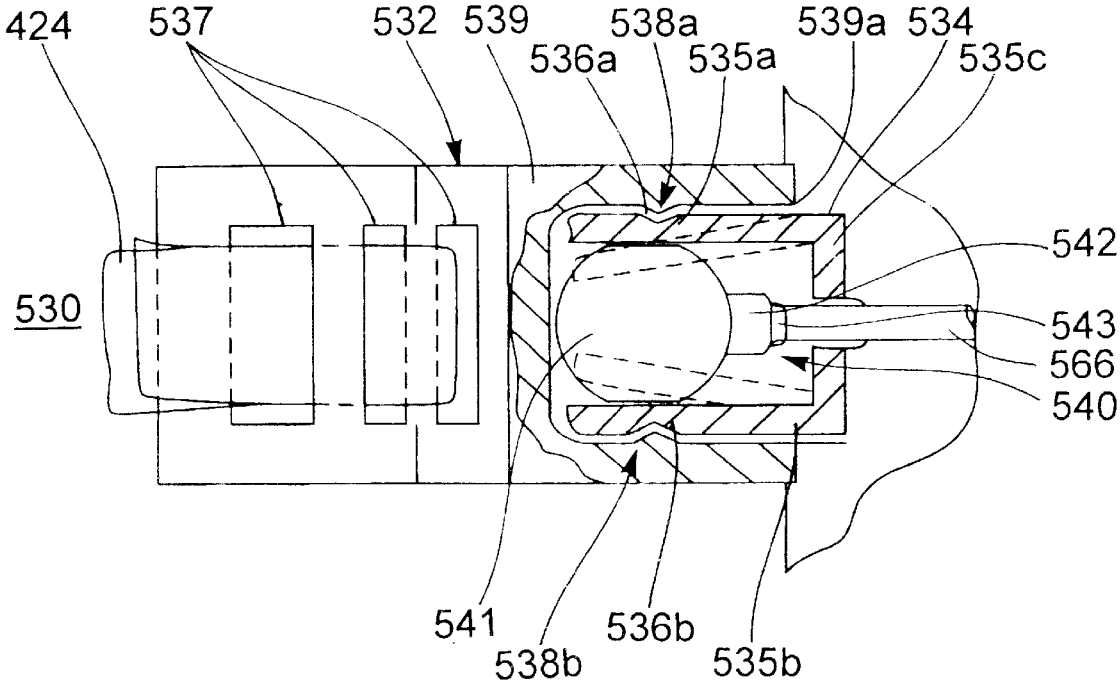
FIG. 11 is a partially broken away plan view of the components of another coupling embodiment of the present invention an automatic release apparatus for a respirator mask, which differs from the components of the previous embodiments.

FIG. 11 is a partially broken away view of yet another coupling embodiment indicated generally at 530 of another automatic release apparatus of the present invention for respirator mask. Coupling 530 preferably includes a first member in the form of a clip 532 which receives a second, generally U-shaped member 534 preferably having a pair of generally parallel spaced apart arms 535*a,* 535*b* with catches 536*a,* 536*b* respectively. The arms 535*a,* 535*b* are supported by a cross member 535*c* having a central opening which receives the actuator 540. Actuator 540 is provided by an expandable member 541 like a balloon having an inlet opening 542 at one end secured by suitable means such as a compression clip 543 to the end of a pneumatic link 566 passed through cross member 535*c* and carrying pressurized gas to both the expandable member 541 and to any respirator mask being used with the coupling 530. Clip 532 may be provided with one or more strap attachment openings 537 at one end and with a housing 539 having at least one open end 539*a* receiving the second coupling member 534. Catches 538*a,* 538*b* are provided in opposing internal side walls of the housing 539 and are located to engage the notches 536*a,* 536*b* on the second member 534. Preferably, member 534 is formed from a resilient metal or plastic and is shaped so that, when undeflected by the actuator 540, its arms 535*a,* 535*b* are withdrawn, as indicated in phantom, from the inner side walls of the housing 539 bearing the catches 538*a,* 538*b* so that the catches do not engage with the notches 536*a,* 536*b* on arms 535*a,* 535*b*. Engagement is made by inflating the expandable member 541.

Figure 12:
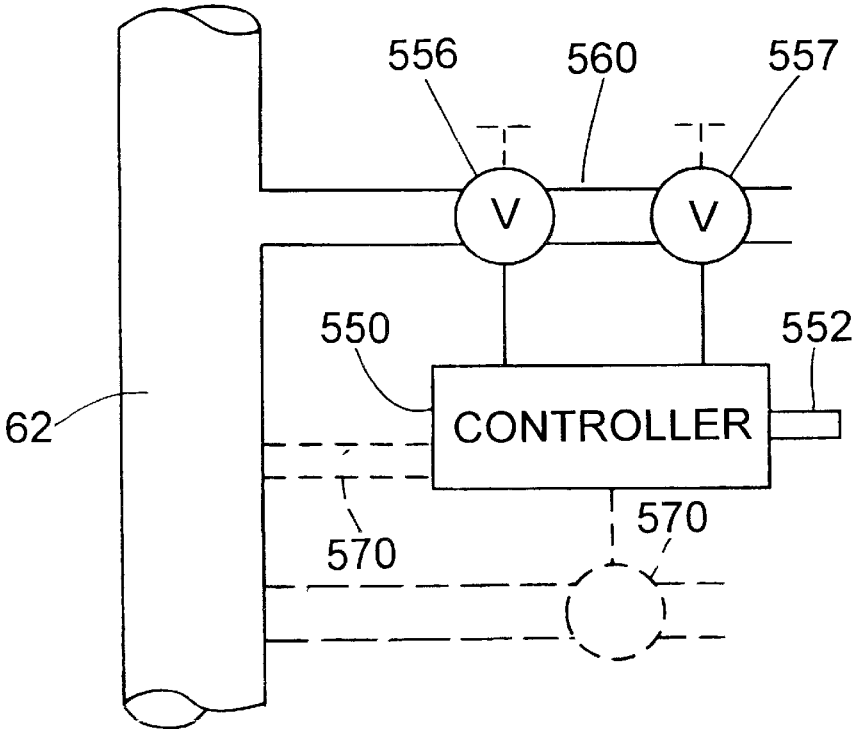
FIG. 12 depicts is a schematic view of the components of different valve arrangements.

FIG. 12 depicts an alternative, valve portion of a respirator device automatic release apparatus of the present invention. A pressurized breathable gas supply 62 is connected with a downstream portion of the apparatus of the present invention through a pair of electrically or otherwise remotely controlled valves 556, 557 by means of a separate controller 550. Valves 556 and 557 may be two way, on/off and vent valves, or may be combined into one three-way valve, respectively, which can be automatically controlled by the controller 550. Controller 550 monitors at least pressure and possibly other parameters such as oxygen content or flow rate of the breathable gas being supplied by the source 62 from the source 62 itself along line 570 (in phantom) or from one of the valves, e.g., valve 556, or from one of the pneumatic links between the valves or between the valves and the source 62. At the same time, the controller 550 monitors the ambient pressure inside a hyperbaric chamber through pneumatic link 552. If the pressure difference between the breathable gas supplied from the source 62 in the interior of the hyperbaric chamber being sensed on link 552 falls below the desired minimum, controller 550 switches the states of the valves causing valve 556 to close and valve 557 to open to atmosphere to vent the downstream portion of the pressurized breathable gas supply network 560.

If pure oxygen is being supplied, valves 556, 557 can be preferably pneumatically or hydraulically operated. In other situations or if desired, the valves 556, 557 can be electrically operated. Each of the valves 556, 557 can be selected to be both manually and automatically operated. In most cases, automatic valves can be selected to fail closed, thereby preventing operation unless manually overridden.

Alternatively, a single three-way valve 570 (in phantom) operating to either pass breathable gas from the source 62 through the remainder of the network 560 or to shut off the gas from the source 62 and vent the downstream portion of the network 560 to atmosphere may be substituted for the two two-way valves 556, 557 and controlled by controller 550.

Figure 13:
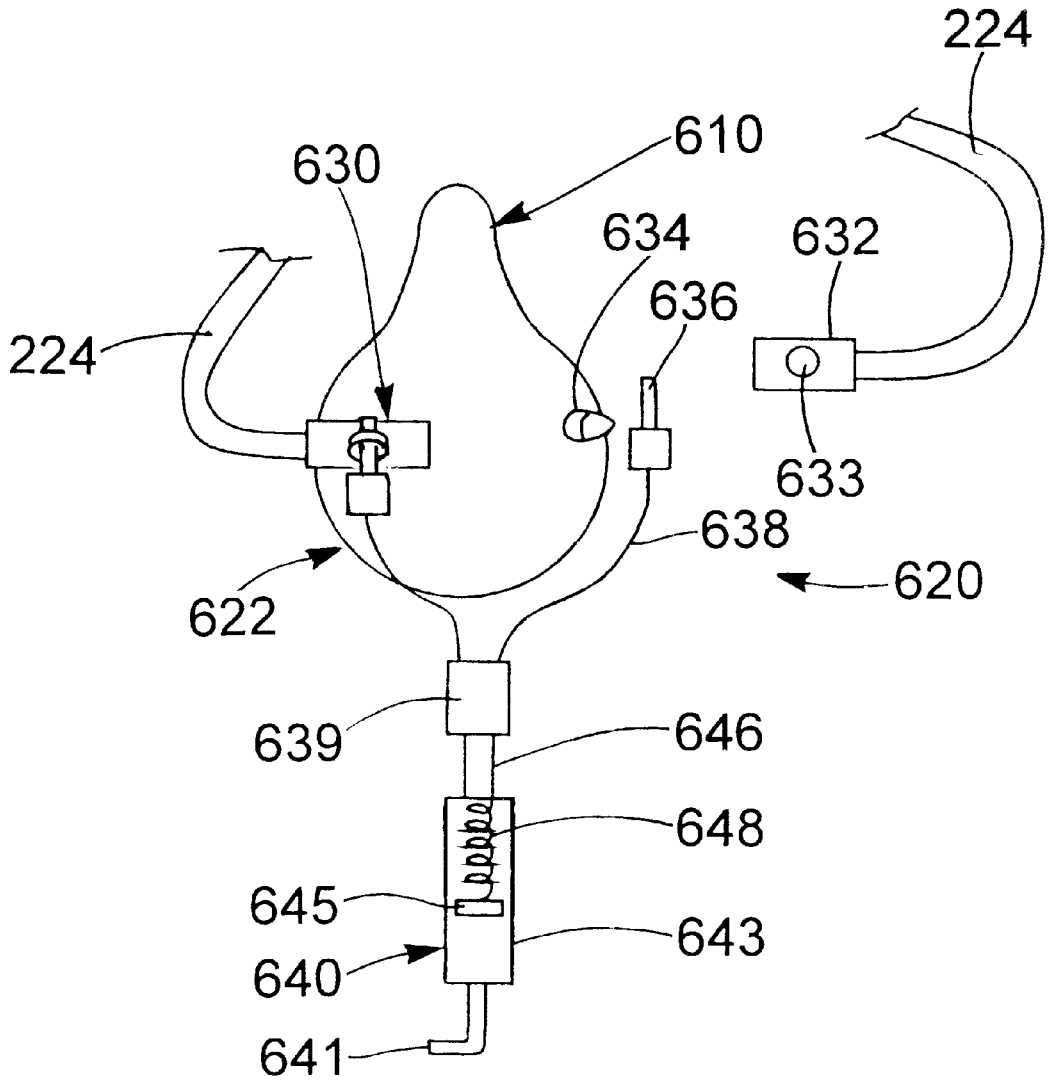
FIG. 13 is a schematic view of a securement device and coupling of an automatic release apparatus of the present invention.
Figure 14:
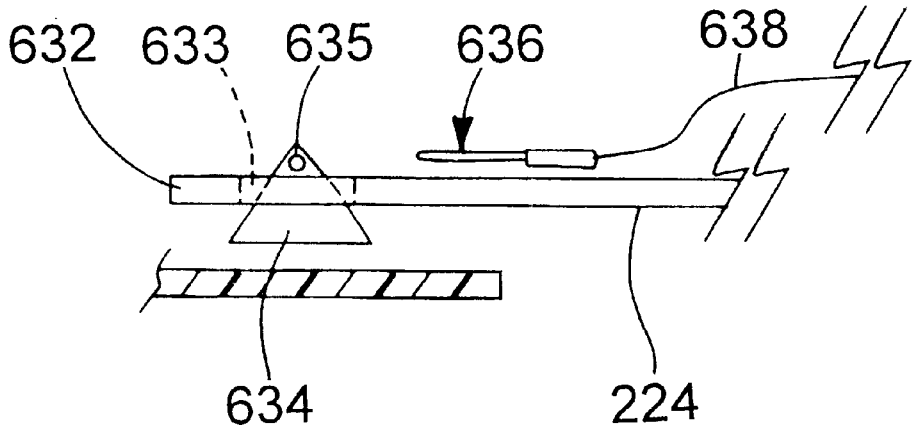
FIG. 14 is a view of the right side of the mask of FIG. 13 just before full assembly of the securement devices.

FIGS. 13 and 14 depict components of yet another embodiment automatic release apparatus of the present invention for respirator mask indicated generally in FIG. 13 at 620 with mask 610. Apparatus 620 includes a securement device indicated generally at 622 and at least one coupling indicated generally at 630 to releasably secure a respirator mask 610 with the securement device 622 around the head of a wearer. The securement device 622 is provided at one or more straps, one sectioned strap being indicated at 224, which is preferably both elastic and adjustable. Preferably, a pair of identical couplings 630 are provided to releasably hold opposing ends of each strap 624 to the respirator mask 610. Each coupling 630 preferably includes a first member in the form of a clip 632, which may be fixedly or, preferably, adjustably mounted to one end of the strap 624, and a post 634 receiving the clip 632. More particularly, clip 632 has a central transverse opening 633 which is received on a post 634 secured to the outer surface of the respirator mask 610. The post 634 has its own transverse opening 635 which releasably receives a pin 636. Pin 636 is in turn coupled by suitable means such as a flexible connector 638 to a pneumatic actuator 640. The details of one such actuator 640 are indicated and include a mini cylinder 643 slidably housing a piston 645 having one end exposed and operably coupled with an end of the connector 638 or other flexible member or a rigid connector 639. Pressurized gas from a gas supply network is supplied to the actuator 640 through an inlet 641. A bias member in the form of a coil spring 648 is provided around a shaft 646 of the piston extending from the cylinder 643. Pressurized gas from the pressurized breathable gas supply network (not depicted) is passed through the inlet 641 under sufficient pressure to keep the spring 648 compressed sufficiently for pins 636 to remain engaged with posts 634 holding the clips 632 on the posts 634. When pressure of the inlet 641 drops to one atmosphere, which would occur on venting of the breakable gas supply network, spring 648 biases piston 645 sufficiently for pins 636 to be pulled from the openings 635 of posts 634 releasing the clips 632.

While only one strap 224 with one pair of couplings 630 is shown, a pair of straps (or more) each with a pair of couplings can be provided, one coupling joining one end of one strap 224 to either side of the respirator mask 610. Preferably, the post 634 is tapered rather than cylindrical to foster the release of clip 632. If desired, a bias member providing a modest bias force such as a soft compression coil spring or foam (neither depicted) can be provided between the clip 632 and the surface of the mask 610 around the post 634 or at another location to urge the clip 632 from the post 634. Also, although pin 636 is shown extending entirely through the post 634, the transverse openings 635 need not go entirely through the posts 634 and, in any event, pin 636 can be extended into a post 634 without extending entirely through the post so that the clip 632 is only secured on one of its sides. In this configuration, the pin 636 operates more like some of the catches which have been described with respect to the earlier embodiments.

Figure 15:
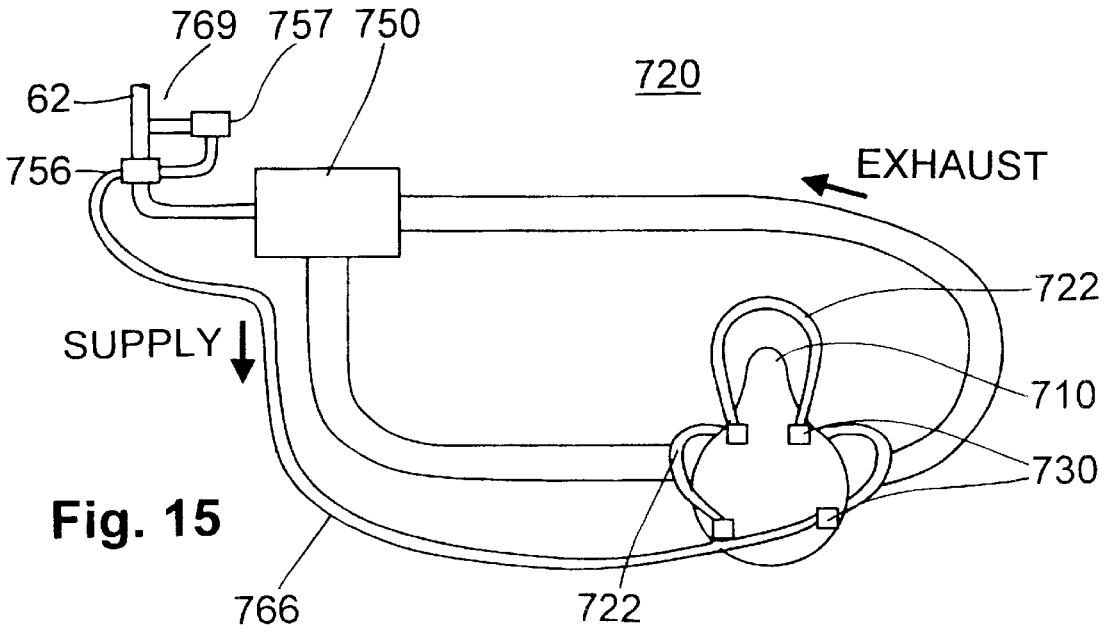
FIG. 15 is a schematic view of yet another embodiment securement and coupling of yet another automatic release apparatus of the present invention for respirator mask.

FIG. 15 depicts schematic components of another automatic release apparatus embodiment indicated generally at 720 utilizing a low pressure or constant flow type of respirator mask 710. The pressure differential which is maintained between the gas supply provided to the mask 710 and the ambient pressure surrounding the mask may be too low for a reasonably sized pneumatic actuator of the mechanism to have enough force to hold the coupling together. In this case, the pneumatic actuator is pneumatically coupled with the pressurized breathable gas supply 62 on the supply side of any pressure or flow control component that is being used to reduce the pressure of breathable gas being supplied to the respirator mask for breathing by the user. Respirator mask 710 having any of the previous forms of securement devices, indicated here generally at 722, is configured to fit around at least the rear side of the head of the respiratory mask wearer and any of the previously indicated couplings, which are indicated generally here at 730, are configured to releasably secure the respirator mask 710 with the securement device 722 around the head of a wearer. A pneumatic actuator supply line 766 is branched from the main supply line 761 by suitable means such as a "T" 769 above a pressure and flow control device 750. The distal end of the pneumatic link 766 is branched in appropriate ways and coupled with each of the pneumatic actuators 730 provided on the mask 710. In some case, it may be desirable or necessary to sense flow of the supply gas to the mask 710. In that case, a flow sensing device indicated schematically in block diagram form at 756, may be provided between supply 61 and the pressure and flow control device 750. The flow sensing trigger 756 could be configured to vent the mask link 766 with the pneumatic actuator(s) 730 to atmosphere in the event breathable gas stopped flowing to the pressure and flow control device 750. Mechanisms for triggering pneumatic operation of the actuator(s) 730 at a specific pressure level might include a pressure differential sensing trigger 757, which may sense differential pressure between supply and ambient across an orifice. Alternatively, paddle in-the-flow or other known technologies could be employed.

Figure 16:
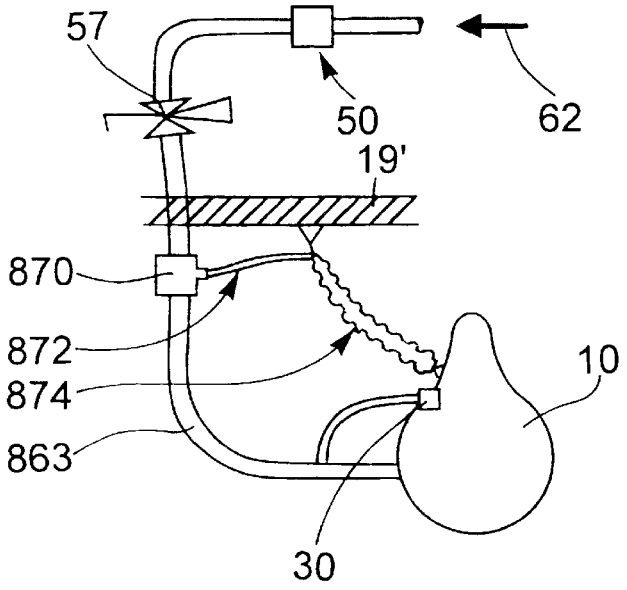
FIG. 16 shows schematically an alternate bias member to urge a respirator mask away from a wearer after the mask has been released, with related components.

FIG. 16 depicts an alternative device to retract a respirator mask from the face of a user after it has been released, for example, in a hyperbaric chamber. Pressurized breathable gas from a supply 62 is provided through an automatic operating valve 50 and a three-way vent valve 57 into a hyperbaric chamber indicated schematically by partial wall 19. Pneumatic link 863 carries the breathable gas to the mask 10 and to at least one pneumatic actuator 30 of the present invention. An additional "T" 870 is provided along the pressurized line and is connected via a pneumatic link 872 with an accordion hose 874. One end of the hose is attached to a fixed base such as the chamber wall 19' and a remaining end is connected to the mask 10. When pressurized gas exceeding the ambient pressure within the chamber is supplied to the accordion hose 874, the hose expands and lengthens. When the hose 874 is vented to ambient atmosphere outside the chamber, ambient pressure within the chamber causes the hose 874 to collapse and retract and the actuators 30 to release the mask 10 thereby permitting the hose 874 to retract the mask 10. The speed of contraction may be controlled by the provision of a restricted orifice somewhere between the hose 874 and "T" 870. The accordion hose should also be covered with a stiff cloth sleeve to prevent squeeze injury when the hose retracts.

Figure 17:
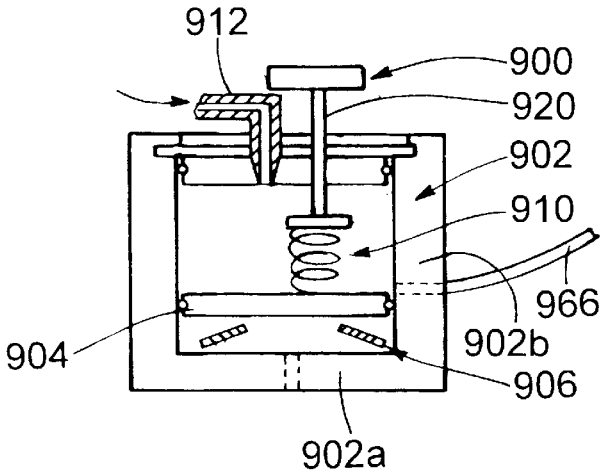
FIG. 17 depicts schematically a differential pressure control device to control the automatically operating gas pressure actuated valve of the apparatus.

FIG. 17 depicts schematically a differential pressure control device 900. A cylinder 902 houses a piston 904. A Belleville washer 906 is positioned between the face of the piston 904 and a vented wall 902*a* of the cylinder 902. The washer 906 is compressed piston 904 by action of a bias spring 910 and by gas pressure provided through inlet 912. A pneumatic link 966 extends from the pneumatic actuator (s) through another wall 902*b* of the cylinder where link 966 is pneumatically coupled with the vented wall 902*a* when the piston 904 is raised by the unloaded Belleville washer 906. Washer 906 can be compressed sufficiently to move the piston 904 between the opening in cylinder wall 902*b* for pneumatic link 966 and the vented wall 902*a* by means of the pressurized gas provided through the inlet 912 and adjustment of the bias spring 910 by a threaded member 920. Bias spring 910 is compressed sufficiently with member 920 so that Belleville washer 906 remains compressed until the anticipated reduce supply pressure at the inlet 912 is reached at which time, the Belleville washer 906 will flex raising the piston and venting the pneumatic link 966 through the cylinder wall 902*a*. This embodiment, if used for any of the actuator(s), will provide a similar action as the Clippard valve but will provide this action from inside the hyperbaric chamber more closely located to the respirator device wearer.

Figure 18:
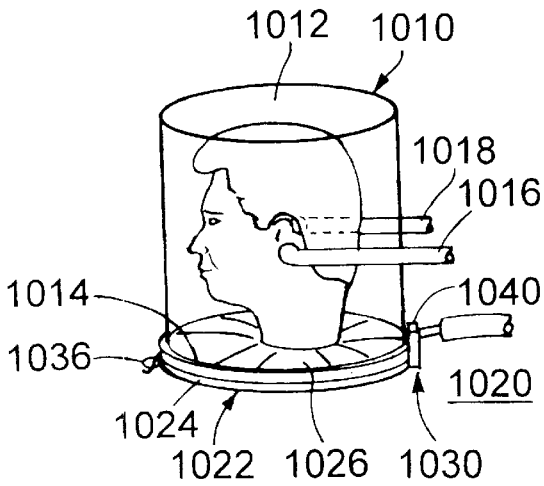
FIG. 18 is a schematic respective view of a respirator hood with another securement and coupling of an automatic release apparatus of the present invention.
Figure 19:
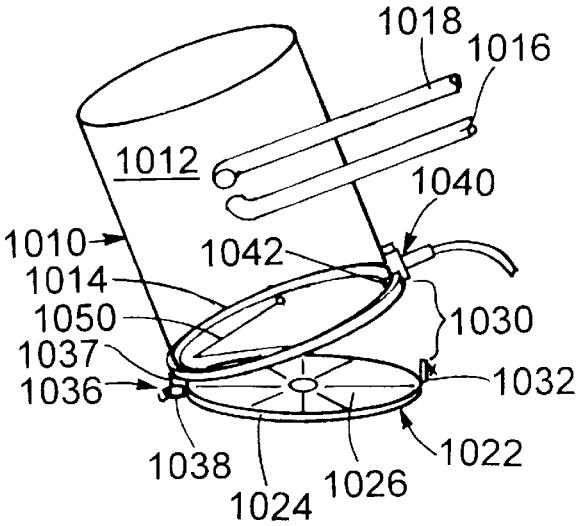
FIG. 19 depicts schematic releasing of the hood of FIG. 18.

FIGS. 18 and 19 depict part of another embodiment automatic release apparatus of the present invention indicated generally at 1020, for use with a respirator hood indicated at 1010. Components of the apparatus 1020 depicted in the two figures include, in addition to the hood 1010, which is configured to completely cover the head of the wearer 16 like a miniature oxygen tent, includes a securement device or collar 1022, which is configured to fit entirely around the neck of the hood wearer 16, and a coupling indicated generally at 1030. The coupling 1030 is configured to releasably secure the respirator hood 1010 with the securement device 1022 on the head of the wearer 16.

The respirator hood 1010 and securement device 1022 are conventional and may be obtained commercially from various sources including, but not limited to, AMRON International Diving Supply of Escondido, Calif. 92025 (Part No. 8891). Such hoods 1010 are provided by a clear plastic envelope 1012 with a stiffening ring 1014 at its base. The hood securement device includes a mating outer stiffening ring 1024 and a rubber neck dam 1026 within the stiffening ring. The dam 1026 has a stretchable central opening which receives the wearer's head. A breathable gas inlet 1016 and a gas outlet 1018 are provided on opposite sides of the envelope 1012. The hood 1010 and securement 1022 are normally releasably held together by a friction fit between the stiffening rings 1014 and 1024. The coupling 1030 may be the same as or similar to any of the previous couplings described above and preferably includes an actuator indicated at 1040 mounted to the stiffening ring 1012 of the hood 1010 and a clip indicated generally at 1032 on the hood securement device 1030. The depicted actuator 1040 is operably coupled with a second, movable member like a latch 1042, which releasably engages clip 1032. It should be appreciated that some wearers may prefer the clip 1032 to be located on the hood 1010 and the actuator 1040 on collar 1022. Preferably, a releasable pivot is provided on the other side of the hood 1010 from the coupling 1030. The releasable pivot is indicated generally at 1036 and may be formed by a hook shaped catch 1037 on stiffening ring 1014 and a mating loop 1038 on stiffening ring 1024. Alternatively, a pair of hooks could be used like those on the mask overlay 26 of FIG. 2. Preferably, a bias member 1050 is provided to separate the hood 1010 from the securement device 1022 when the clip 1032 is released by the actuator 1040 and its member 1042. The bias member 1050 may be a V-shaped leaf spring as indicated between the two stiffening rings or some other biasing member between the hood 1010 and securement device 1022. Alternatively, a separate bias member, like bias member 13 of FIG. 1, may be connected with the hood 1010 directly or indirectly and to another base member such a wall of a hyperbaric chamber or the seat or bed supporting the wearer or the like to pull (or push) the hood 1010 from the wearer's head when the actuator 1040 causes release of the clip 1032. Preferably, the actuator 1040 and clip 1032 pair and the hook 1034 and loop 1035 pair are located on opposite sides of the hood 1010 and collar 1022 and opposite sides of the bias member 1050, or the bias member is otherwise provided in such a way that the hood 1010 and securement device collar 1022 separate at the back of the wearer's head so that the hood 1010 moves forwardly over the wearer's head and off of the wearer's face. The rest of the apparatus supplying the breathable gas would be the same as for a low pressure or constant flow respirator mask of the type referred to earlier with respect to FIG. 15.

Figure 20:
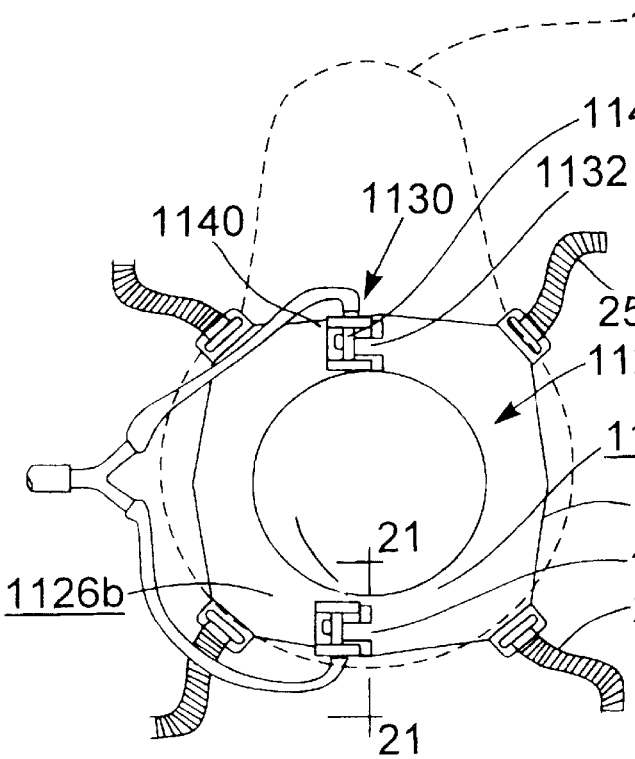
FIG. 20 depicts yet another coupling embodiment of the present invention for an automatic release apparatus for respirator device, in particular a respirator mask, which provides direct securement between an actuator and a first member of the coupling.
Figure 21:
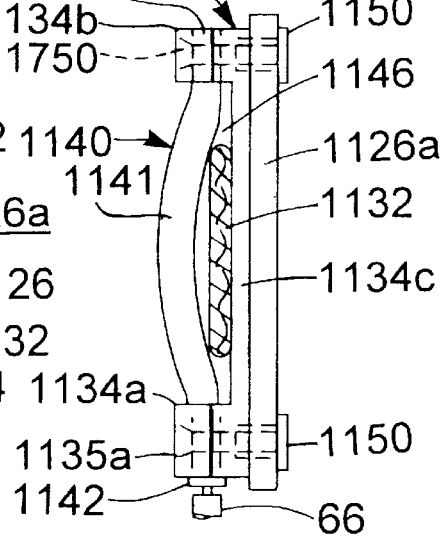
FIG. 21 is a plan view of the actuator of the coupling of FIG. 20 taken along lines 21—21.

FIGS. 20 and 21 depict yet another coupling of the present invention like that of FIG. 11, but simpler and more direct. The coupling, indicated generally at 1130 releasably secures a conventional respirator mask 10 (in phantom) with a securement device 1122 around the head of the wearer. The securement device includes at least one and preferably two straps 24, 25 and a multipiece mask overlay 1126 similar to the overlay 26 of FIG. 1 except for the coupling 1130 which releasably holds together the pieces 1126*a* and 1126*b*. Coupling 1130 includes at least a first member 1132, which is preferably nothing more than a flexible tab extending from one of the overlay pieces 1126*a* to an actuator 1140 fixedly secured to the other, remaining overlay piece 1126. Actuator 1140 is very similar to actuator 540 of FIG. 11 and is also seen in greater detail in FIG. 21. Actuator 1140 preferably includes a tubular, rectangular housing 1143 formed by a generally U-shaped frame member 1144 and cover or cap 1145, and an expandable, in particular, inflatable member 1141, more particularly, an inflatable tube, in the housing 1143. Cover 1145 is shown of transparent material (e.g., acrylic plastic) for visibility, but could be opaque. Frame member 1144 includes a base or cross piece 1144*c* with a pair of spaced-apart, transverse arms or bosses 1144*a*, 1144*b*. Cover 1145 has similar parts 1145*a*, 1145*b* and 1145*c*. Inflatable member/tube 1141 has an inlet opening 1142 at one end secured by suitable means such as clamping between frame member 1144 between member 1144 and cover 1145 to one end of a pneumatic link 66 as it passes through one end of housing 1143. The distal end of inflatable member 1141 is preferably clamped between opposing ends 1144*b*, 1145*b* of the frame member 1144 and the cover 1145. The cover 1145 can be secured to frame member 1144 by suitable means such as threaded fasteners 1150, rivets, clips or other suitable connectors. Elongated slots 1146 are thus formed between the expandable member 1141 and each of the frame member 1144 and cover 1145. Slots 1146 are sufficiently wide between the arms 1144*a* and 1144*b* to receive the flexible tab 1132 on the overlay piece 1126*a*. At least the tab 1132 and preferably the entire overlay 1126 is formed from a flexible material such as leather, cloth, natural or synthetic rubber and certain other appropriately flexible plastic materials or composite materials. The overlay 1126 (or at least its tab(s) 1132) should have a relatively high coefficient of surface friction so that the tab(s) 1132 can be frictionally engaged directly with the actuator 1140 between the expandable member 1141 and frame 1144 or cover 1145 when the inflatable member 1141 is suitably pressurized and released from engagement when the inflatable member 1141 loses pressure. It will be appreciated that the foregoing coupling 1130 eliminates a second engagement member moved by the actuator 1140 that all of the previous coupling embodiments had. Inflatable member 1141 is both actuating member and engagement member of actuator 1140.

Figure 22:
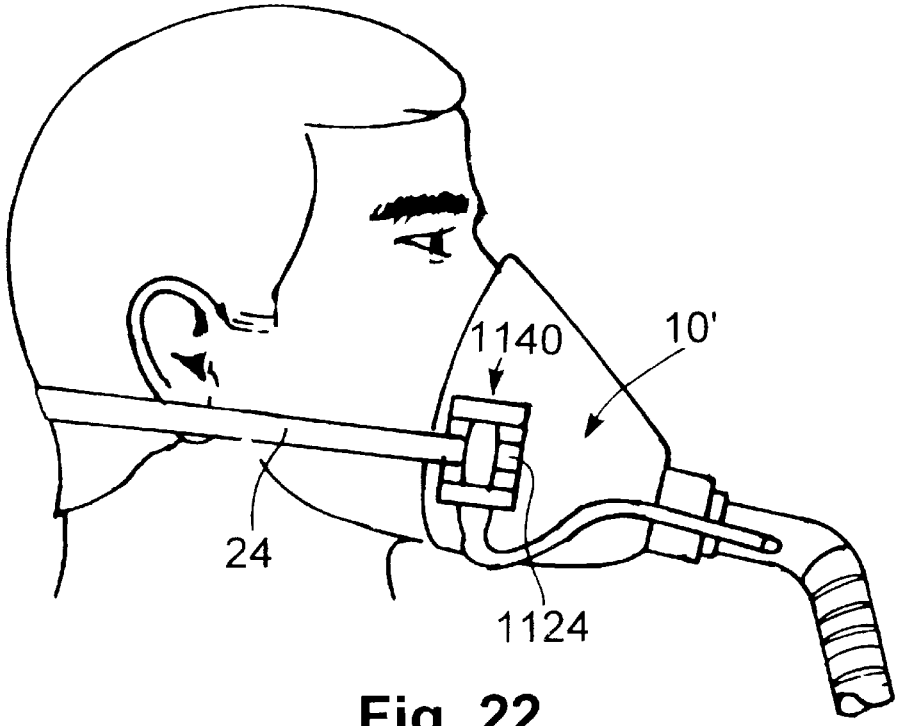
FIG. 22 depicts a coupling like that of FIGS. 20 and 21 mounted directly with a respirator mask.

FIG. 22 is a view illustrating actuator 1140 of FIGS. 20 and 21 being used to directly couple a respirator mask 10' with the end of a strap 24. The distal tip 1124 of strap 24 is received between the inflatable member 1141 and cross piece 1144*c* as was flexible tab 1132 in FIGS. 20–21. Frame 1144 is secured directly to the mask by suitable means such as a fastener (not depicted). It will be appreciated that the mountings can be reversed: that the actuator 1140 can be mounted on the end of a strap and an engagable tab provided extending from the mask. It will be further appreciated that a coupling can be provided between ends of a strap (like 224*a*, 224*b* in FIG. 7), with the actuator 1140 secured to one strap end (e.g., 224*a*) and the remaining strap end (224*b*) releasably received in the actuator.

Figure 23:
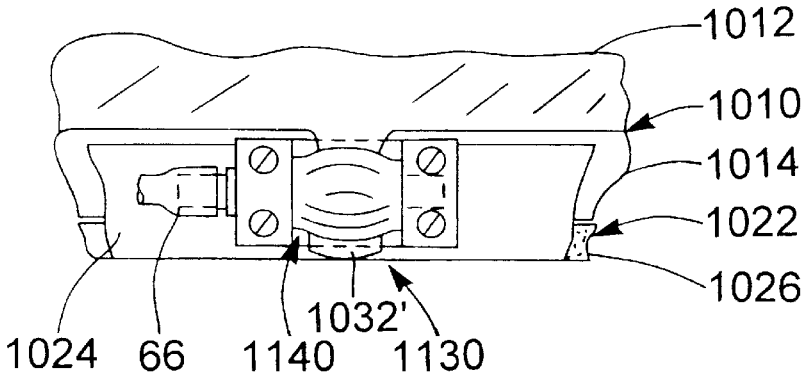
FIG. 23 depicts a coupling like that of FIGS. 20 and 21 mounted directly with a respirator hood.

FIG. 23 is a localized view illustrating coupling 1130 being substituted for coupling 1030 in the embodiment of FIGS. 18–19 to releasably secure one side of a respirator hood 1010 with the hood securement device 1022. Again, the actuator 1140 is preferably located on the securement device 1022 and a tab 1032' is extended from the hood 1010.

Figure 24:
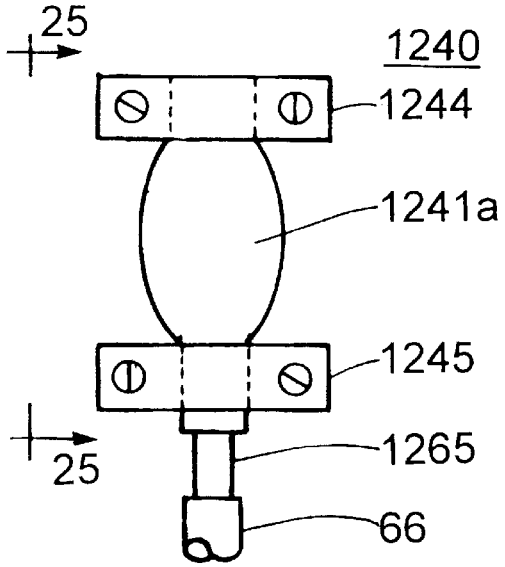
FIG. 24 depicts yet another coupling embodiment providing direct securement between an actuator and a first member of the coupling.
Figure 25:
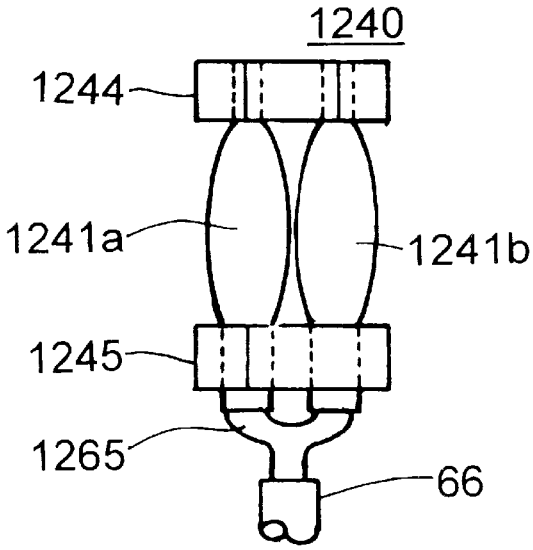
FIG. 25 depicts the coupling of FIG. 24 when viewed along the lines 25—25.

FIGS. 24 and 25 depict schematically a modified actuator 1240. A pair of inflatable members 1241*a*, 1241*b* are provided extending between closed ends of a tubular, rectangular housing 1143. The inflatable members are spaced sufficiently closely together in the housing 1143 so that when the remaining member of the coupling (the tab) is received between them, the tab is secured directly by the inflatable members 1241*a*, 1241*b*. The housing 1143, 1244 may be formed from two U-shaped members 1244*a*, 1244*b* and two spacers 1245*a* and 1245*b* held together by suitable means. Preferably members 1241*a*, 1241*b* are inflated together from a common pressurized air supply 66 by suitable means such as a manifold 1265. It will further be appreciated that other couplings using direct engagement by the pneumatic actuators, including Bourdon tube actuators, can be designed.

Still other variations can be made to the different apparatus embodiments and components disclosed above and remain within the scope of the present invention. For example, the housings 1143 and 1243 of actuators 1140 and 1240 could be made in other shapes from other components. Although a fully closed rectangular tube shape is preferred to provide backing support for the inflatable member(s) 1141.

Although one or more straps have been disclosed with or without an overlay as constituting all or part of the securement device for a respirator mask, other members can be provided extending around a respirator mask wearer's head, including but not limited to: a hard helmet, a soft cap and anything between a soft cap and a constant width head strap including, but not limited to, a head net, a harness, etc. Also, in all of the embodiments described above having a second member moved by the actuator except the FIG. 11 embodiment, the second member portion of each of the mask couplings could be characterized as a male member being received in a "female" opening or depression in a first fixed or stationary coupling member. The movable portion of the coupling alternatively might be a movable part of a structure, like a gate, defining part of the perimeter of a female opening or depression receiving a mating, fixed male member of the coupling. Also, while breathable gas is supplied to both the device (mask or hood) and the actuator at the same pressure, the invention is also considered to include (1) supplying separate gases at the same pressure to the mask or hood and the actuator(s); or (2) separating and adjusting (e.g., reducing or increasing) the pressure of the breathable gas supplied to the actuator(s) from that being supplied to the device for breathing; or both (1) and (2).

Alternatively, operative force may be provided to actuators, clasps and/or clips hydraulically or, less desirably in an oxygen-rich atmosphere, electrically or electromagnetically, or in other ways without combustion or explosion. Also, while pneumatic control of this system is preferred, hydraulic and/or electric control can be used. All such alternative methods and devices are intended to be encompassed by the present invention.

While only one hose is shown supplying gas to the mask wearers, many masks have an additional hose to provide an overboard dump.

Finally, referring to FIG. 11, it has been found that satisfactory results can be provided by actuator including an inflated member like member 541 in a rigid frame and a tab-like "clip" 532 inserted between the member and the frame and secured while the member (541)is inflated and released when it is deflated. The "clip" in this case need only be a piece of flexible material like cloth, leather, Neoprene, etc. The actuator could be formed by two inflatable members without a rigid backing. The tab/clip would be inserted between the two inflatable members. The flexible tab could be held by friction or serrations or other surface treatment(s) could be provided to any of the components for increased grip. The resulting actuators are quite simple in construction, light in weight and without moving parts other than the inflatable members themselves.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An automatic release apparatus to use with a respirator device configured to cover at least part of a wearer's face so as to provide breathable gas to at least the wearer's mouth or nose, the automatic release apparatus comprising:

a securement device configured to fit around at least part of a respirator device wearer's head; and a coupling configured to releasably secure a respirator device with the securement device to the wearer's head, the coupling including at least a first member and an actuator operatively yet releasably coupled with the first member, the actuator having a gas inlet and being coupled with the first member so as to secure the first member in engagement to maintain the coupling while the actuator is pressurized by gas supplied to the actuator gas inlet and to release the first member to break the coupling when the actuator is insufficiently pressurized.

2. The automatic release apparatus according to claim 1 wherein the coupling further comprises a second member movable with respect to and releasably engagable with the first member, the actuator being connected with the second member to permit release of the first and second members from one another in the absence of sufficiently pressurized gas at the actuator gas inlet.

3. The automatic release apparatus according to claim 2 further comprising a separate bias member coupled with at least one of the second member and the actuator so as to disengage the second member from the first member during the absence of sufficiently pressurized gas at the actuator gas inlet.

4. The automatic release apparatus according to claim 1 further comprising an automatically operating gas pressure actuated valve pneumatically connected with the actuator gas inlet so as to vent the actuator to atmosphere in response to a sufficient drop in pressure of gas supplied to the actuator gas inlet.

5. The automatic release apparatus according to claim 1 further comprising pressurized gas supply network pneumatically connecting together the actuator and the respirator device at a common gas pressure.

6. The automatic release apparatus according to claim 1 further comprising an automatically operating gas pressure actuated valve having a first pressurized gas inlet connection, a second gas connection pneumatically connected with at least the actuator, and a vent to atmosphere.

7. The automatic release apparatus according to claim 6 further comprising a manually actuated valve pneumatically connected with the first pressurized gas inlet connection of the automatically operating gas pressure actuated valve.

8. The automatic release apparatus according to claim 6 further comprising a manually actuated valve pneumatically connected between the automatically operating gas pressure actuated valve and the actuator of the coupling.

9. The automatic release apparatus according to claim 6 wherein the automatically operating gas pressure actuated valve further has a third gas connection to ambient atmosphere immediately surrounding the respirator device.

10. The automatic release apparatus according to claim 1 wherein the securement device includes a multipiece respirator mask overlay configured to at least partially overlie a respirator mask to hold the mask on a wearer's face and wherein the coupling releasably holds together at least two pieces of the overlay.

11. The automatic release apparatus according to claim 1 wherein the first member of the coupling is adapted to be mounted on one of the respirator device and the securement device and wherein the actuator of the coupling is adapted to be mounted on a remaining one of the respirator device and the securement device.

12. The automatic release apparatus according to claim 1 to use specifically with a respirator mask type respirator device wherein the securement device includes a respirator mask overlay and at least one strap and wherein the first member of the coupling is adapted to be mounted on one of a respirator mask and the strap and wherein actuator of the coupling is adapted to be mounted on a remaining one of the respirator mask and the strap.

13. The automatic release apparatus according to claim 1 wherein the securement device includes a respirator mask overlay and at least a pair of straps, each strap having an end secured with the overlay and an opposing, free end, and wherein the first member of the coupling is mounted on the free end of one of the pair of straps and wherein the actuator is mounted on the free end of a remaining one of the pair of straps.

14. The automatic release apparatus according to claim 1 in combination with a respirator device having an inner side configured to fit over at least part of a wearer's face covering at least the wearer's mouth or nose, the combination further comprising:

a gas pressure regulator pneumatically connected between the actuator and the inner side of the respirator device, the gas pressure regulator requiring for operation a breathable gas supplied at a minimum pressure above an ambient pressure on the respirator device; and an automatically operating gas pressure actuated valve pneumatically connected with the actuator and with the gas pressure regulator, the valve further having an outlet to vent to atmosphere pressurized gas between the valve and the actuator, and the valve further being responsive to pressure of a breathable gas supplied through the valve to the actuator and to the gas pressure regulator and to ambient pressure on the respirator device to vent the breathable gas being supplied to the actuator and to the pressure regulator when the breathable gas pressure drops below the minimum pressure above ambient pressure on the respirator device.

15. The automatic release apparatus according to claim 14 further comprising a respirator device bias member connected with the respirator device so as to withdraw the device at least from the user's face when the coupling releases.

16. The respirator device and automatic release apparatus combination of claim 14 wherein the respirator device, the securement device and the coupling are interconnected together within a hyperbaric chamber.

17. The automatic release apparatus of claim 1 in further combination with a respirator mask.

18. The automatic release apparatus of claim 1 in further combination with a respirator hood.

19. A method of automatically releasing a respirator device at least from a wearer's face comprising the steps of:

supplying pressurized breathable gas at least at a predetermined initial minimum pressure above ambient atmospheric pressure around the respirator device simultaneously to the respirator device and to an actuator of a coupling releasably securing the respirator device on the wearer's head, the coupling further including at least a first member, the actuator being operatively yet releasably connected with the first member of the coupling; and the actuator releasing the first member of the coupling to break the coupling and release the respirator device when the pressure of the breathable gas being simultaneously supplied to the respirator device and to the actuator drops below a minimum maintenance pressure required to operate the respirator device for the ambient atmospheric pressure around the respirator device.

20. A method of automatically holding a respirator device to a wearer's face in a hyperbaric chamber comprising the steps of:

supplying a pressurized breathable gas at least at a predetermined initial minimum pressure simultaneously to the respirator device and to an actuator of a coupling releasably securing the respirator device on the wearer's head, the coupling further including at least a first member, the actuator being operatively yet releasably connected with the first member of the coupling; and pressurizing the wearer, together with the respirator device and the coupling, in the hyperbaric chamber with a breathable atmosphere while simultaneously supplying to each of the actuator and the respirator device inner side, the breathable gas, the breathable gas being supplied to the respirator device and the actuator being measurably different in composition from the breathable atmosphere pressurizing the hyperbaric chamber.

* * * * *